US005606799A

United States Patent [19]

Melton

[11] Patent Number: 5,606,799

[45] Date of Patent: Mar. 4, 1997

[54] DETACHABLE PIVOTING CLIPPER BLADES

[75] Inventor: Scott Melton, Erie, Ill.

[73] Assignee: Wahl Clipper Corporation, Sterling, Ill.

[21] Appl. No.: 327,436

[22] Filed: Oct. 21, 1994

[51] Int. Cl.[6] ..... B26B 19/06

[52] U.S. Cl. ..... 30/216; 30/199

[58] Field of Search ..... 30/208, 209, 210, 30/211, 216, 1, 220, 228, 89, 194, 43.92, 199

[56] References Cited

U.S. PATENT DOCUMENTS

| | | | |
|---|---|---|---|
| 511,966 | 1/1894 | Olsen . | |
| 1,455,751 | 5/1923 | Hartman . | |
| 1,997,096 | 4/1935 | Andis . | |
| 2,067,075 | 1/1937 | Clark . | |
| 2,222,317 | 11/1940 | Martin . | |
| 3,099,086 | 7/1963 | Anderson . | |
| 3,217,409 | 11/1965 | Proffitt . | |
| 3,279,056 | 10/1966 | Andis . | |
| 3,672,049 | 6/1972 | Demci et al. . | |
| 4,112,271 | 9/1978 | Marchetti | 30/43.92 X |
| 4,125,940 | 11/1978 | Ihasz et al. . | |
| 4,332,321 | 6/1982 | Wratschko . | |
| 4,512,077 | 4/1985 | Tanabe et al. . | |
| 4,581,822 | 4/1986 | Fujimura . | |
| 4,700,476 | 10/1987 | Locke et al. . | |
| 4,765,060 | 8/1988 | Veselaski et al. . | |
| 4,926,553 | 5/1990 | Miskin et al. . | |
| 5,007,168 | 4/1991 | Messinger et al. . | |
| 5,068,966 | 12/1991 | Wahl et al. . | |
| 5,165,172 | 11/1992 | Weinrauch | 30/210 X |

FOREIGN PATENT DOCUMENTS

| | | |
|---|---|---|
| 0147134 | 7/1985 | European Pat. Off. . |
| 0375949 | 7/1990 | European Pat. Off. . |
| 2639280 | 5/1990 | France . |
| 2660589 | 10/1991 | France . |
| 2663255 | 12/1991 | France . |
| 2141065 | 12/1984 | United Kingdom . |

*Primary Examiner*—Hwei-Siu Payer
*Attorney, Agent, or Firm*—Greer, Burns & Crain, Ltd.

[57] ABSTRACT

A hair clipper including a handle portion having a drive end with a first coupler formation, a blade assembly having a housing at least partially enclosing a reciprocating blade and a fixed blade, and having a second coupler formation for engaging the first coupler formation, the first and second coupler formations forming a ball-and-socket connection.

22 Claims, 2 Drawing Sheets

DETACHABLE PIVOTING CLIPPER BLADES

RELATED APPLICATION

The present application is related to co-pending application Ser. No. 08/327,235 entitled "CLIPPER BLADE ASSEMBLY" filed on Oct. 21, 1994.

BACKGROUND OF THE INVENTION

The present invention relates to electric hair clippers, trimmers and shavers, and specifically to such devices having blade assemblies which are pivotable and/or rotatable, and in some cases detachable relative to the handle.

Presently there are two tools used to clip patients' hair prior to surgery: the disposable manual razor, and the electric clipper. Aside from its total disposability, which is a sanitary advantage, a major advantage of the manual razor is that it provides a stubble-free surface preferred by many physicians. However, clinical studies have shown that nicks caused by pre-operative shaving with razors may contribute to post-operative infections. Thus, many physicians are now recommending that such shaving be done with electric clippers, which clear the operation site of the majority of unwanted hair to improve visibility without causing infections.

Conventionally available electric clippers include two main components: a combined handle and drive system, and a removable, disposable blade assembly. The blade assembly includes a housing enclosing a fixed blade and a moving blade coaxially reciprocating relative to the fixed blade. When used in medical applications, the blade assembly is packaged in a sealed bag for sterility. Just prior to surgery, the hospital technician opens the bag and attaches the blade assembly to the handle. Upon completion of the shaving operation, the blade assembly is removed and discarded.

One disadvantage of these conventional clipper units with removable blade assemblies is the difficulty in properly engaging the blade assembly on the handle so that the drive member, normally a rotating eccentric cam member or reciprocating drive finger, will properly engage the cam follower in the reciprocating blade of the blade assembly. Conventional units require the operator or technician to perform relatively complicated multiple alignment and engagement steps to properly mount the blade assembly, which can be a frustrating and time consuming procedure.

Another disadvantage of conventional electric clippers used in surgery preparation is that once engaged upon the handle, the blade assembly is in a fixed position relative to the handle. Consequently, it is often awkward to properly shave certain hard-to-reach or sensitive body surfaces.

Yet another disadvantage of conventional clippers is that in some models the end of the blade assembly housing which slides along the skin is of insufficient surface area to enable the technician or operator to positively control the blade position or cutting angle as the clipper is passed over the skin or against a hair comb.

Still another disadvantage of conventional surgical clippers is that the removal of the blade assembly for disposal may subject the technician to contact with the sharp blades, with the resulting possibility of the technician becoming infected with diseases of the patient.

Thus, a first object of the present invention is to provide an improved hair clipper wherein the blade assembly is easily rotatable and pivotable in many directions.

Another object of the present invention is to provide an improved blade assembly for a hair clipper which is easily engaged upon the handle portion in a single movement without complicated manipulation, and which is also easy to remove without causing the operator or technician to contact the blades.

Yet another object of the present invention is to provide an improved blade assembly for a clipper wherein the blade housing provides sufficient surface area for facilitating operator control over the angle at which the blades cross the skin for the most efficient cutting over skin or against a hair comb.

Still another object of the present invention is to provide an improved disposable blade assembly for a clipper wherein the number of components is minimized to lower manufacturing and user costs.

SUMMARY OF THE INVENTION

Accordingly, the above-listed objects are met or exceeded by the present detachable pivoting clipper blades, which are pivotable about the handle portion of the clipper in many directions using a ball-and-socket connection. Actual 360° rotation and substantial pivotability is achieved by the present ball-and-socket configuration. Major advantages of this feature include the clipper's more ergonomic configuration which enables the operator to hold the clipper at a more comfortable angle, while still maintaining an optimum cutting angle.

In addition, the present blade assembly is readily engaged upon the handle portion for quick and easy engagement, and also has a pop-off tab feature which permits the used blade assembly to be ejected from the handle portion with one hand without the operator touching the blades. Further, the large surface area of the contacting surface of the blade assembly housing facilitates accurate control over the unit's cutting angle, whether applied against the skin or against a hair comb.

More specifically, the present invention provides a hair clipper including a handle portion having a drive end with a first coupler formation. Also included with the clipper is a blade assembly having a housing at least partially enclosing a reciprocating blade and a fixed blade, and having a second coupler formation for engaging the first coupler formation, said first and second coupler formations forming a ball-and-socket connection.

In another embodiment, the present invention provides a hair clipper including a handle portion having a drive end with a first coupler formation. Also included with the clipper is a blade assembly having a housing at least partially enclosing a reciprocating blade and a fixed blade, and having a second coupler formation for engaging the first coupler formation, so that upon engagement of the first and second coupler formations, the blade assembly is rotatable about the drive end.

In a further embodiment, the present invention provides a hair clipper including a handle portion having a drive end with a first coupler formation. The blade assembly includes a housing at least partially enclosing a reciprocating blade and a fixed blade. Also included on the blade assembly is a second coupler formation for engaging the first coupler formation so that upon engagement, the blade assembly is movable relative to the handle portion. One of the first and second coupler formations is provided with biased release structures for readily disengaging from the other of the first and second coupler formations.

In still another embodiment, a disposable blade assembly for use with a hair clipper is provided, the clipper including a handle with a drive end, a drive member extending from the drive end, and a coupler formation disposed at the drive end. The blade assembly includes a housing having a swivel formation configured for rotatably and pivotally engaging the coupler formation, the swivel formation defining a recess for accommodating the drive member and also having blade locating formation for locating a fixed blade thereon. A fixed cutting blade configured for engagement on the blade locating formation is also found in the assembly, as is a movable cutting blade being configured for reciprocal linear movement relative to the fixed cutting blade. Lastly, a cam follower is provided for engaging the drive member through the opening in the swivel formation and for exerting a biasing force on the fixed and movable cutting blades.

DETAILED DESCRIPTION OF THE PREFERRED EMBODIMENT

Figure 1:
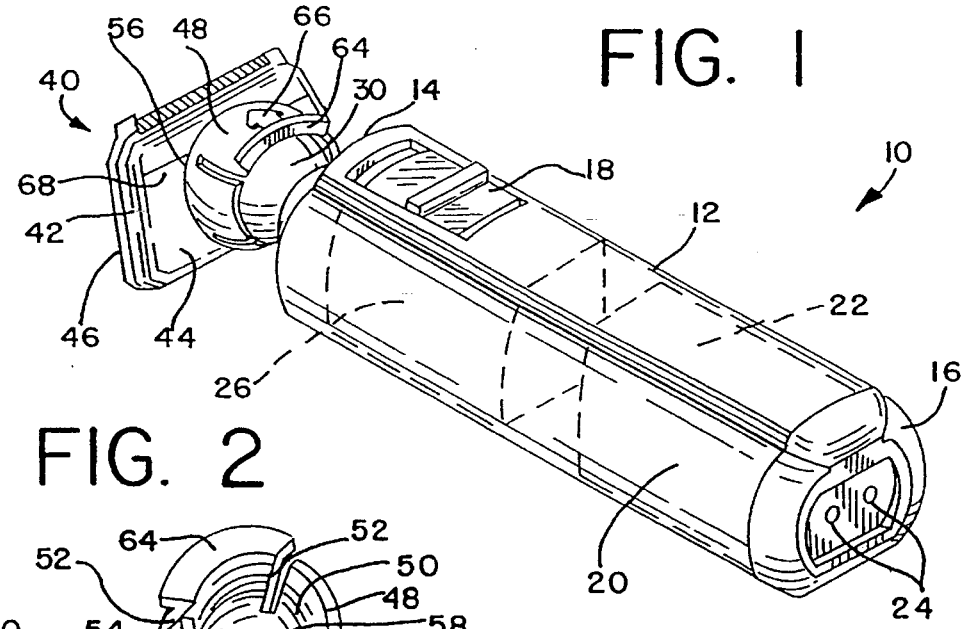
FIG. 1 is a top perspective elevational view of a hair clipper incorporating the detachable blades of the invention.
Figure 4:
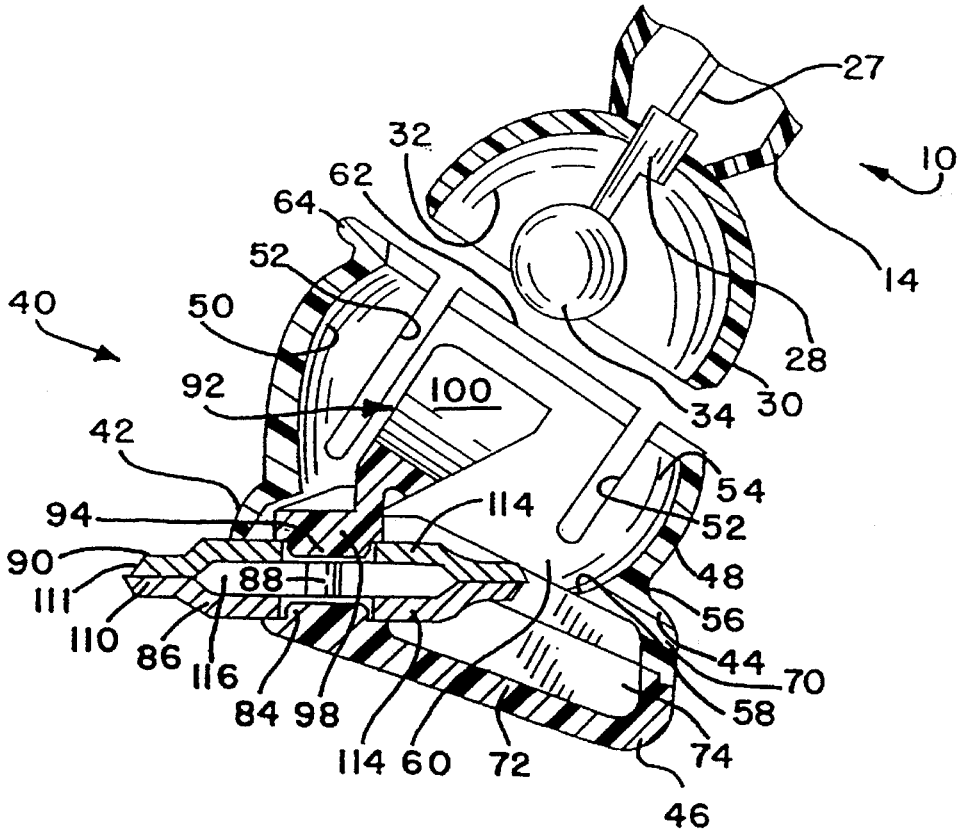
FIG. 4 is a sectional view taken along the line 4—4 of FIG. 3 and in the direction indicated generally, and also including a fragmentary sectional view of the handle portion shown in FIG. 1.

Referring now to FIGS. 1 and 4, an electric hair clipper of the type suitable for use in the present invention is generally designated 10, and includes a motorized handle portion 12 having a drive end 14, a recharge end 16 opposite the drive end, and a switch 18 located therebetween. More specifically, the handle portion 12 includes a housing 20 preferably made of durable, impact-resistant molded polymeric or plastic material as is known in the art. Enclosed by the housing 20 is a battery 22 (shown hidden), which in the preferred embodiment is rechargeable, however disposable batteries are also contemplated. Terminals 24 for engaging a recharging stand (not shown) are located at the recharge end 16.

Connected to the battery 22 in a known manner is an electric motor 26 (shown hidden) which is secured within the housing 20, is electrically connected to the switch 18, and which has a drive shaft or armature 27 secured to an offset cam eccentric 28 (best seen in FIG. 4). The arrangement and operation of the motor 26, the battery 22, and the cam eccentric 28 are similar to components which are well known in the art and are described in detail in commonly assigned U.S. Pat. No. 5,068,966, which is incorporated by reference herein.

At the drive end 14 is provided a first coupler formation 30 which is frusto-spherical or bowl-like in shape and defines a central cavity 32 (best seen in FIG. 4) into which projects the cam eccentric 28 and a lobe or spherically shaped drive actuator member 34. The actuator member 34 is preferably fixed upon the cam eccentric 28. In fact, the actuator member 34 and the cam eccentric 28 may be machined as a single piece, and it is contemplated that any equivalent method of attaching a ball to orbit about the centerline of a motor shaft may be suitably employed.

Referring now to FIGS. 1–4, included with the clipper 10 is a blade assembly, generally designated 40, which is made up of a blade assembly housing 42 preferably having a first housing portion 44 and a second housing portion 46. The first housing portion 44 includes a shroud or swivel formation 48 which is also generally frusto-spherical or bowl shaped and defines a central recess 50. The formation 48 defines a socket dimensioned to accommodate the first coupler formation 30 and is preferably dimensioned to encompass and accommodate the first coupler formation in a ball-and-socket connection, and as such is also referred to as a second coupler formation. Either of the first and second coupler formations 30, 48 may be located on either of the blade assembly 40 or the drive end 14. Upon engagement of the first and second coupler formations 30, 48, the blade assembly 40 is preferably pivotable and rotatable about the drive end 14. A significant feature of the present coupling of the blade assembly 40 to the drive end 14, is that a full 360° of rotation of the blade assembly is available, as well as a substantial degree of pivotability, which in the preferred embodiment is in the range of 30°. The pivotability feature allows the blade assembly 40 to be moved up, down and to either side in varying degrees relative to the base position shown in FIG. 1.

In the preferred embodiment, the swivel formation 48 is provided with a biasing force with which it grips the first coupler formation 30, and which may be overcome when the blade assembly 40 is disengaged from the coupler formation 30 of the handle portion 12. Such biasing force is provided by at least one and preferably four notches 52 defining the swivel formation 48 into multiple spring-biased tabs 54. To facilitate both the pivoting action of the swivel formation 48 relative to the coupler formation 30, the formation 48 is preferably made of a relatively more resilient plastic material, or is constructed to have a lower spring rate, while the formation 30 is more rigid either through material selection or component construction as is known in the art. It is also contemplated that the relative flexibility of the formations 48 and 30 may be reversed.

Figure 3:
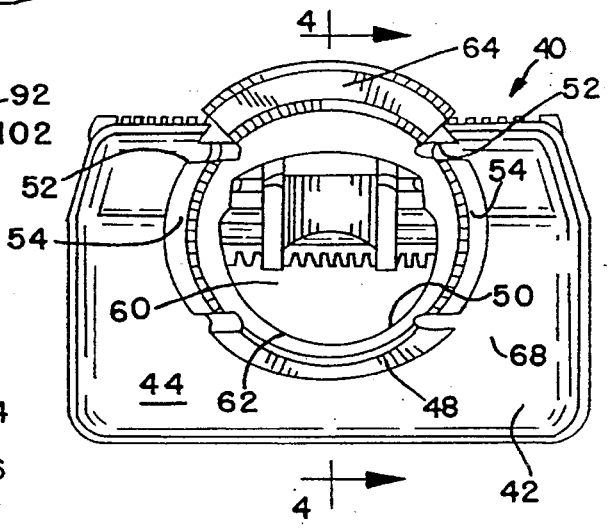
FIG. 3 is a rear end view of the blade assembly depicted in FIG. 2.

At a base end 56 of the swivel formation 48 is defined an opening 58 which is in communication with an interior housing chamber 60 (best seen in FIG. 3). Opposite the base end 56, the swivel formation includes an annular rim 62 and preferably at least one radially extending release tab 64 integrally joined to said rim. In the preferred embodiment, the release tab 64 is constructed and arranged to be large enough to be engaged by an operator's thumb. When force is exerted, as by the operator's thumb, in the direction indicated by an arrow 66 (best seen in FIG. 1), the blade assembly 40 will be disengaged from the handle portion 12. An added feature is that the arrow 66 is integrally molded onto the swivel formation 48 to serve as a permanent indicator. Aside from the swivel formation 48, the first housing portion 44 includes an upper surface 68 to which the swivel formation is attached, and a depending skirt 70.

The second housing portion 46 has a substantially planar floor 72 with an upstanding peripheral wall 74 on three sides, 76, 78 and 80. The peripheral wall 74 is constructed and arranged to be fixed to opposing portions of the depending skirt 70 using chemical adhesive, ultrasonic or RF welding, or other suitable attachment technologies. A feature of the present blade assembly 40 is that the floor 72 has a lower surface with a significant surface area with which to contact the subject's skin and/or to contact a hair comb, depending on the application. In this manner, guidance is provided to the operator for hair clipping purposes.

Figure 2:
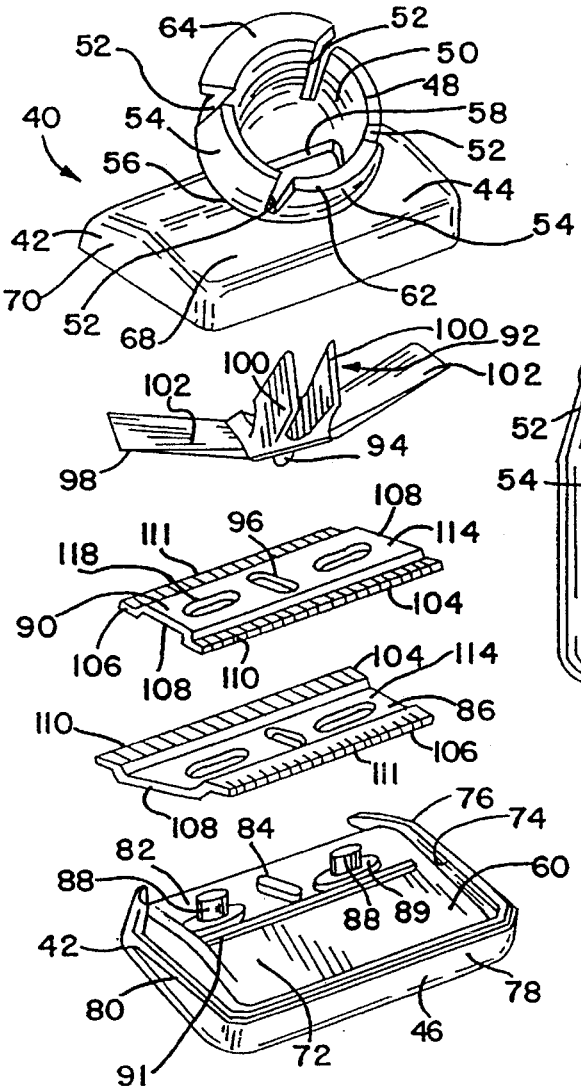
FIG. 2 is an exploded perspective view of the present detachable clipper blade assembly.

Referring now to FIG. 2, the floor 72 is generally inclined toward an open side 82 and is provided with a blade locating lug 84 which is preferably integrally formed with the floor 72. The lug 84 is preferably elongate in shape and has a longitudinal axis which is generally parallel to the sides 76 and 80. Further, the lug 84 has a height preferably designed to be slightly taller than the cross-sectional thickness of a fixed blade 86 to maintain the blade in a fixed position on the floor 72. It is also contemplated that the lug 84 may be slightly shorter than the blade thickness, as long as the blade 86 is prevented from moving.

Adjacent each side of the lug 84 is disposed a blade guide boss 88 which is secured to the floor 72 for guiding a reciprocating blade 90 relative to the fixed blade 86. The blade guide bosses 88 also have broad shaped bases 89 which aid in supporting and securing the fixed blade 86 in position on the floor 72. In the preferred embodiment, the blade guide bosses 88 are each preferably oriented at a 90° to the blade locating lug 84, and preferably have a relatively equal or greater height for engaging the moving blade 90 as will be described below. It is also preferred that the floor 72 be provided with a support rib 91 which projects vertically from the floor to support an underside of the fixed blade 86.

In addition to the first and second housing portions 44, 46, and the fixed and reciprocating blades 86, 90, the blade assembly 40 further includes a cam follower, generally designated 92, for engaging the drive actuator member 34 in the central recess 50 in the swivel formation 48. The orbital eccentric motion of the drive actuator member 34 is translated into reciprocating linear action at the reciprocating blade 90 by a blade driver lug 94 or similar formation (best seen in FIG. 4) which extends from the cam follower 92 and engages a central slot 96 on the blade 90. The lug 94 is preferably dimensioned to be tall enough to maintain engagement with the slot 96 without interfering with the upper end of the blade locating lug 84.

Another function of the cam follower 92 is to exert a biasing force on the fixed and reciprocating cutting blades 86, 90. Such a biasing force is directed toward the floor 72, is generally normal to the axis of motion of the reciprocating blade 90, and urges the reciprocating blade 90 against the fixed blade 86.

Referring now to FIGS. 2–4, the cam follower 92 preferably consists of a single integrally formed piece, fabricated by injection molding or equivalent technology. A generally rectangular and planar base 98 serves on an upper side as the attachment point of a cam follower formation 100. In shape, the formation 100 may be generally forked to fit snugly onto the spherical drive actuator member 34 to be driven thereby and still permit a wide range of pivotal motion of the head assembly 40 without interfering with the driving action. In other words, the actuator member 34 and the cam follower formation 100 form a ball joint. Thus, the formation 100 is configured to be driven by the actuator member 34 and still permit a wide range of rotational and pivotal motion of the head assembly 40 without interfering with the driving action. An important feature of the head assembly 40 is that it is rotatable 360° relative to the coupling end, and is also pivotable approximately 30° from a base position as shown in FIG. 1.

A result of the engagement of the forked cam follower 100 on the spherical drive actuator member 34 is that the driving lug 94 is maintained at a constant diametrical distance from the member 34 throughout a wide range of motion, regardless of the orientation of the head assembly 40 to the coupling assembly 30. This engagement is important for achieving the rotatability of the head assembly 40 relative to the coupler formation 30. The formation 100 also is long enough to project through the opening 58 and into the recess 50 defined by the swivel formation 48. The cam follower formation 100 is generally opposite the location on the base 98 from which depends the blade driver lug 94.

Located laterally adjacent each side of the cam follower formation 100 on the base 98 is an integrally formed, resilient, upwardly or vertically inclined wing formation 102. The wings 102 are constructed to resist a downwardly directed vertical force, and thus exert a biasing force on the base 98 near the driver lug 94. As such, when the cam follower 92 is assembled into the housing 42, the wings 102 will engage the underside of the upper surface 68 of the first housing portion 44, and accordingly will cause the base 98 to exert a biasing force against the uppermost reciprocating blade 90. The reciprocating blade 90 will slidingly engage the fixed blade 86, and the blades 86, 90 will thus be biased against each other and the floor 72.

Figure 5:
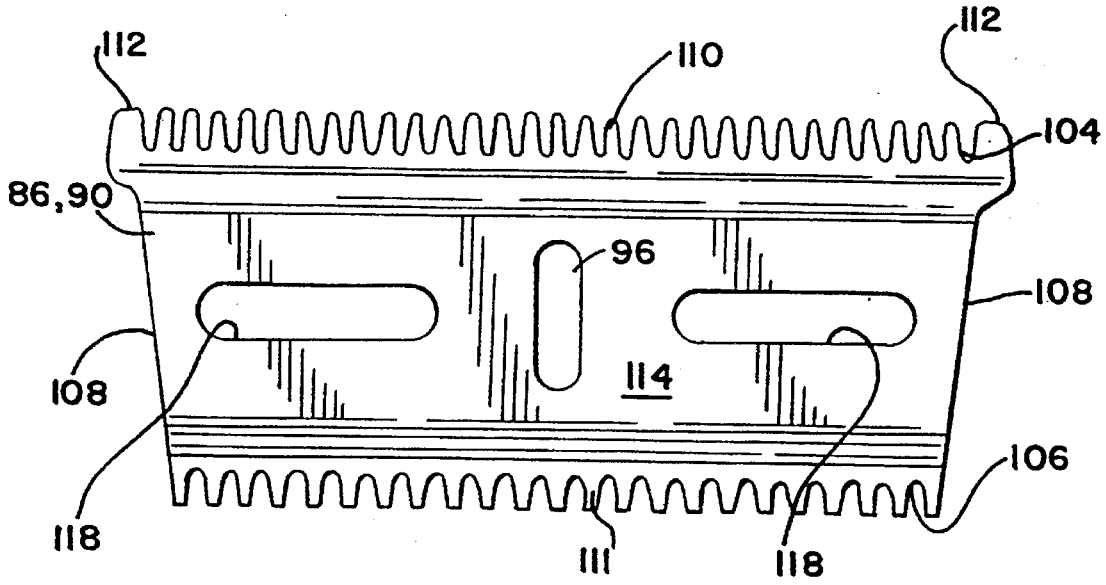
FIG. 5 is an overhead plan view of a blade suitable for use in the assembly of FIG. 2.

Referring now to FIGS. 2, 4 and 5, the blades 86, 90 will be described in greater detail. Each blade 86, 90 has a wide edge 104, a narrow edge 106, and a pair of angled sides 108. Each of the wide and narrow edges 104, 106 has a corresponding plurality of teeth 110, 111. It is preferred that the teeth 111 on the narrow edge 106 are more truncated or cut off to provide sharper corners for cutting, and are spaced more widely than the teeth 110 of the wide edge 104. Further, in the present embodiment, the teeth 111 have side cutting edges with a greater rake angle than the teeth 110. The actual teeth configuration employed will depend on the application of the product and manufacturing requirements. It will be seen that the wide edge 104 has a wider outside tooth 112 at each end thereof. These outside teeth 112 allow more protection against cutting and nicking of the skin by the edge 106. Generally, the differences in tooth shape and spacing provide a more efficient cutting action than when identical tooth patterns are used for both blades.

A central web portion 114 is vertically offset from the edges 104, 106, so that when the blades 86, 90 are placed back-to-back in the housing 42, as seen in FIG. 4, a space 116 is defined therebetween. On the web portion 114 is found the centrally located slot 96, and an elongate guide slot 118 on each side of the central slot. Each guide slot 118 is dimensioned to slidingly accommodate one of the blade guide bosses 88, and is long enough to accommodate the reciprocal stroke of the reciprocating blade 90.

Referring now to FIG. 4, it will be seen that the reciprocating blade 90 is slightly offset laterally away from the fixed blade 86. This relative position of the blades is intended to prevent nicking and/or cutting the skin of the person whose hair is being clipped. The offset relationship is provided by placing the guide slots 118 slightly closer to the narrow edge 106 than to the wide edge 104. In a preferred embodiment, the guide slots 118 are on the order of 0.012 inch closer to the narrow edge 106.

In other words, given a centerline of the blades 86, 90 taken parallel to the edges 104, 106, the guide slots 118 are offset from the centerline. A function of this offset construction is when an offset distance X is desired between the fixed and moving blades 86, 90, and the blades are identical in configuration, the offset of the guide slots 118 from the center line is 0.5 X.

Another feature of the present blade assembly 40 is that the same part may be used for both blades 86 and 90. Accordingly, the blades 86 and 90 may be substantially identical, depending on the finishing operations performed on each. The wide edge 104 serves as the fixed blade edge, and the narrow edge 106 serves as the reciprocating blade moving relative to the fixed blade.

In operation, the blade assembly 40 is assembled by placing a fixed blade 86 upon the blade locator lug 84 and upon the base 89 on the floor 72 so that the teeth 110 extend out the open side 82. The rib 91 provides further support to the blade 86. At this time, the tops of the blade guide bosses 88 will extend through the guide slots 118, but provide no guidance since the blade is fixed. The bosses 88 guide the reciprocating blade 90 relative to the fixed blade 86. The reciprocating blade 90 is placed upon the taller guide bosses 88 so that its narrower edge 106 extends out the open side 82, and is inverted relative to the fixed blade 86 so that the space 116 is formed between the two blades. However, the opposing toothed edges 104 and 106 will be in sliding contact with each other (best seen in FIG. 4). Although the guide bosses 88 engage the guide slots 118, the blade locator lug 84 does not engage the reciprocating blade 90.

Next, the cam follower 92 is disposed upon the reciprocating blade 90 so that the blade driver lug 94 is inserted into the central slot 96. The lug 94, as is the locator lug 84, is dimensioned to be tightly accommodated in the central slot 96 to prevent unwanted play in the blades 86, 90. The driver lug 94 does not engage the fixed blade 86. As the uppermost first housing portion 44 is lowered upon the reciprocating blade 90, the cam follower formation 100 passes through the opening 58 and extends into the central recess 50 of the swivel formation 48. Once the first housing portion 44 is fastened to the lowermost second housing portion 46, the engagement of the resilient wings 102 against the first housing portion 44 will exert a biasing force against the reciprocating blade 90 to hold that blade against the fixed blade 86, and also hold the fixed blade against the floor 72 of the second housing portion 46. As seen in FIG. 4, the blades 86, 90 are only partially enclosed by the housing 42 and project from the open side 82 to engage hair to be clipped.

Attachment of the blade assembly 40 to the handle portion 12 proceeds by engaging the swivel portion 48 about the first coupling 30 portion of the handle portion. The clamping tabs 54 are spread slightly to accommodate the insertion of the first coupling portion, but then retract over the drive end 14 to secure the components together. At the same time, the forks of the cam follower formation 100 snugly fit upon the drive actuator member 34.

Upon assembly, the blade assembly 40 has 360° of rotational movement, approximately 30° of pivotal movement, and is able to be positioned by an operator or technician in a wide variety of angular orientations to facilitate clipping. Also, the eccentric rotation of the drive actuator member 34 is translated by the cam follower 100 into the linear reciprocating movement of the blade 90 relative to the blade 86 regardless of the angular orientation of the blade assembly to the handle portion 12.

A significant advantage of the construction of the clamping tabs 54 and the cam follower 100 is that the operator may readily align and attach the blade assembly 40 upon the handle portion 12 by merely exerting an axially directed pushing force upon the blade assembly towards the handle portion. Unlike conventional designs, there is no special alignment or manipulation required to achieve proper engagement of the blade assembly upon the handle, and engagement of the cam follower may be accomplished in a single operation.

Upon completion of the clipping operation, the operator or technician may place the clipper 10 near a disposal container. The tab 64 is pressed by the operator's thumb or finger in the direction of the indicator arrow 66, and the entire blade assembly 40 will pop off into the disposal container without requiring the operator to come in contact with the sharp blades or the use of two hands. Prior art clippers with detachable heads require two hands or the touching of blades by the operator, which may expose the operator to contamination.

While a particular embodiment of the detachable pivoting clipper blades of the invention has been shown and described, it will be appreciated by those skilled in the art that changes and modifications may be made thereto without departing from the invention in its broader aspects and as set forth in the following claims.

What is claimed is:

1. A hair clipper, comprising:

a handle portion having a drive end with a first coupler formation;

a blade assembly including a housing at least partially enclosing a reciprocating blade and a fixed blade, and having a second coupler formation for engaging said first coupler formation, said first and second coupler formations forming a ball-and-socket connection; and at least one of said first and second coupler formations being provided with at least one notch for defining said formation into multiple loaded tabs such that said at least one said first and second coupler formations exerts a biasing force upon the other of said first and second coupler formations.

2. The hair clipper as defined in claim 1 wherein said ball-and-socket connection comprises a ball member and a socket member configured so that upon engagement of said first and second coupler formations, said ball member is rotatable within said socket member, and said blade assembly is rotatable about said drive end.

3. The hair clipper as defined in claim 1 wherein said ball-and-socket connection comprises a ball member and a socket member, said ball member being rotatable and pivotable in any direction within said socket member, thereby forming a connection which provides pivotable as well as rotatable motion.

4. The hair clipper as defined in claim 1 wherein said clipper includes a drive actuator member projecting from said drive end, and said blade assembly further includes a blade driver with a cam follower for engaging said drive actuator member, and a blade driving formation for engaging said reciprocating blade.

5. The hair clipper as defined in claim 4 wherein said blade driver further includes spring means associated with it for exerting a biasing force against said reciprocating and said fixed blades.

6. The hair clipper as defined in claim 5 wherein said spring means includes at least one wing formation integrally formed with said blade driver.

7. The hair clipper as defined in claim 4 wherein said cam follower has a forked configuration for engaging and forming a ball joint with said drive actuator member, which has a generally spherical configuration.

8. The hair clipper as defined in claim 1 wherein one of said first and second coupler formations is provided with release means for readily disengaging from the other of said first and second coupler formations.

9. The hair clipper as defined in claim 8 wherein said second coupler formation is a shroud with an annular rim, and said release means includes a tab projecting from said rim.

10. The hair clipper as defined in claim 8 further including indicator means on said release means for indicating the direction in which said release means is to be activated by a user to release said first coupler formation from said second coupler formation.

11. A hair clipper, comprising:

a handle portion having a drive end with a first coupler formation; and a blade assembly including a housing at least partially enclosing a reciprocating blade and a fixed blade, and having a second coupler formation for engaging said first coupler formation, so that upon engagement of said first and second coupler formations form a ball-and-socket connection such that said blade assembly is both pivotable, to the extent that said blade assembly is movable up, down and to either side in varying degrees relative to said handle portion, and also is rotatable about said drive end;

said handle portion includes a drive actuator member projecting from said drive end, and said blade assembly further includes a blade driver with a cam follower for engaging said drive actuator member, and a blade driving formation for engaging and moving said reciprocating blade, said drive actuator member passing through said connection to engage said blade driver.

12. The hair clipper as defined in claim 11 wherein at least one of said first and second coupler formations is configured to exert a releasable biasing force upon the other of said first and second coupler formations upon said coupler formations forming said ball-and-socket connection, such that said one coupler formation forming a socket portion of said ball-and-socket connection exerts a releasable biasing force on a ball portion of said connection.

13. The hair clipper as defined in claim 11 wherein one of said first and second coupler formations is provided with release means for readily disengaging from the other of said first and second coupler formations.

14. The hair clipper as defined in claim 11, wherein said cam follower and said drive actuator member are configured so that a driving relationship is maintained regardless of the angular position of the blade assembly relative to said handle portion.

15. A hair clipper, comprising:

a handle portion having a drive end with a first coupler formation;

a blade assembly including a housing at least partially enclosing a reciprocating blade and a fixed blade, and having a second coupler formation for engaging said first coupler formation to form a connection so that upon engagement, said blade assembly is pivotable and rotatable relative to said handle portion; and one of said first and second coupler formations being provided with biased release means for readily disengaging from the other of said first and second coupler formations, said biased release means being a component of said connection so that said connection is the point of disengagement of said coupler formations.

16. A disposable blade assembly for use with a hair clipper, the clipper including a handle with a drive end, a drive member extending from the drive end, and a coupler formation disposed at the drive end, said blade assembly comprising:

a housing having a swivel formation configured for pivotally and rotatably engaging the coupler formation, said swivel formation defining a recess for accommodating the drive member;

said housing also having blade locating means for locating a fixed blade thereon;

a fixed cutting blade being configured for engagement on said blade locating means;

a movable cutting blade being configured for reciprocal linear movement relative to said fixed cutting blade; and cam follower means for engaging said drive member through said recess in said swivel formation and for exerting a biasing force on said fixed and movable cutting blades.

17. The blade assembly as defined in claim 16 wherein said swivel formation is configured such that, upon engagement with the coupler formation, said swivel formation forms a ball-and-socket joint with said coupler formation.

18. The blade assembly as defined in claim 16 wherein said assembly is rotatable in the range of 360 degrees about the drive end.

19. The blade assembly as defined in claim 16 wherein the drive member is spherical in shape, and said cam follower means has a generally forked shape for engaging said drive member.

20. The blade assembly as defined in claim 16 wherein said swivel formation is bowl shaped, and has a tab formation for facilitating release of said assembly from said drive end.

21. The blade assembly as defined in claim 16 wherein said cam follower means includes at least one spring means associated therewith for exerting said biasing force on said blades.

22. A hair clipper, comprising:

a handle portion having a drive end with a first coupler formation;

a blade assembly including a housing at least partially enclosing a reciprocating blade and a fixed blade, and having a second coupler formation for engaging said first coupler formation, said first and second coupler formations forming a ball-and-socket connection;

one of said first and second coupler formations is provided with release means for readily disengaging from the other of said first and second coupler formations, and said release means includes a tab projecting from said coupler formation for facilitating one-handed release by a user.

* * * * *